US009967670B2

(12) United States Patent
Zhang

(10) Patent No.: US 9,967,670 B2
(45) Date of Patent: May 8, 2018

(54) AUDIO COLLECTION APPARATUS

(71) Applicant: Scenes Sound Digital Technology (Shenzhen) Co., Ltd, Shenzhen (CN)

(72) Inventor: Ruibo Zhang, Shenzhen (CN)

(73) Assignee: Scenes Sound Digital Technology (Shenzhen) Co., Ltd, Shenzhen (CN)

( * ) Notice: Subject to any disclaimer, the term of this patent is extended or adjusted under 35 U.S.C. 154(b) by 0 days. days.

(21) Appl. No.: 15/484,484

(22) Filed: Apr. 11, 2017

(65) Prior Publication Data

US 2017/0223459 A1 Aug. 3, 2017

Related U.S. Application Data

(63) Continuation of application No. PCT/CN2016/077366, filed on Mar. 25, 2016.

(30) Foreign Application Priority Data

Dec. 15, 2015 (CN) ..... 2015 1 0940314

(51) Int. Cl.

| | |
|---|---|
| ***H04R 5/027*** | (2006.01) |
| ***H04R 1/02*** | (2006.01) |
| ***H04S 1/00*** | (2006.01) |
| *H04R 1/32* | (2006.01) |

(52) U.S. Cl.

CPC ..... *H04R 5/027* (2013.01); *H04R 1/02* (2013.01); *H04R 1/326* (2013.01); *H04R 2201/025* (2013.01); *H04S 1/002* (2013.01); *H04S 2400/15* (2013.01)

(58) Field of Classification Search

CPC .... H04R 5/027; H04R 1/02; H04R 2201/025; H04S 1/002; H04S 2400/15

See application file for complete search history.

(56) References Cited

U.S. PATENT DOCUMENTS

| | | | | |
|---|---|---|---|---|
| 4,119,798 A * | 10/1978 | Iwahara | H04S 3/002 381/19 |
| 9,552,747 B1 * | 1/2017 | Lytle | G09B 23/30 |
| 2011/0135205 A1 * | 6/2011 | Rhee | G06T 7/60 382/195 |
| 2017/0035344 A1 * | 2/2017 | Tzvieli | A61B 5/411 |

FOREIGN PATENT DOCUMENTS

CN 202759558 U * 2/2013

* cited by examiner

*Primary Examiner* — Sonia Gay

(74) *Attorney, Agent, or Firm* — Ladas & Parry LLP

(57) ABSTRACT

The present invention is applicable to the field of audio recording and provides an audio collection apparatus. Multiple fixed apparatuses are stacked and have ear structures and face contours, and audio collectors are disposed at ear canal openings of the ear structures to collect audio information. During audio collection, faces of the fixed apparatuses have different horizontal orientations, so that the audio collectors obtain the audio information at the ear canal openings of the ear structures towards horizontal directions. Therefore, rich sound sources and sound authenticity are ensured, sounds are rich in quality, a stereo field perception effect is achieved, a real sound field relationship can be restored, an in-head effect is avoided, and a requirement for real synchronization between a sound and an image in a virtual reality (VR) panoramic video technology is met.

3 Claims, 2 Drawing Sheets

AUDIO COLLECTION APPARATUS

This application claims priority to Chinese Patent Application No. 201510940314.4, filed with the Chinese Patent Office on Dec. 25, 2015 and entitled "AUDIO COLLECTION APPARATUS", which is incorporated herein by reference in its entity. This application is a continuation application of PCT Patent Application No. PCT/CN2016/077366.

TECHNICAL FIELD

The present invention belongs to the field of audio recording, and particularly, relates to an audio collection apparatus.

BACKGROUND

In a conventional computer graphics technology, a field of view is changed by using a mouse or a keyboard, and a visual system of a user is separated from a motion perception system. However, with the development and popularization of a virtual reality (VR) panoramic video technology, a visual angle of a picture is changed by means of head tracking, so that the visual system and the motion perception system of the user are connected, and the user can observe a presented scene through head motion. A VR panoramic video device enables the user to watch a video at any visual angle within 360 degrees. In order to bring stereo perception experience to users by using the VR panoramic video technology, an audio recording technology in a panoramic video also becomes a focus. In a process of receiving sound waves by human ears, the auricle, the ear canal, the skull, the shoulder, and the like may reflect and diffract the sound waves, and then the sound waves are conducted to the ear drum and perceived by brain nerves. All these have certain impact on sounds heard by the human ears. In acoustics, such impact is described by using a head related transfer function (HRTF). Therefore, the human brain can determine a position and a distance of an emitted sound according to experience.

An existing audio recording device is single in sound source, has flat and non-stereoscopic tone quality and a severe in-head effect, and cannot restore a real sound field or meet a requirement for real synchronization between a sound and an image in the VR panoramic video technology.

SUMMARY

Embodiments of the present invention provide an audio collection apparatus and aims to resolve problems that an existing audio recording device is single in sound source, has flat and non-stereoscopic tone quality and a severe in-head effect, and cannot restore a real sound field or meet a requirement for real synchronization between a sound and an image in a VR panoramic video technology.

The embodiments of the present invention are implemented in the following manner: An audio collection apparatus is characterized by including multiple fixed apparatuses that are stacked, where the fixed apparatuses have ear structures and face contours; and audio collectors that are disposed at ear canal openings of the ear structures and configured to collect audio signals at the ear canal openings, where during audio collection, faces of the fixed apparatuses have different horizontal orientations.

The present invention provides a recording device. Multiple fixed apparatuses are stacked and have ear structures and face contours, and audio collectors are disposed at ear canal openings of the ear structures to collect audio information. During audio collection, faces of the fixed apparatuses are towards different horizontal directions, so that the audio collectors obtain the audio information at the ear canal openings of the ear structures towards the horizontal directions. Therefore, rich sound sources and sound authenticity are ensured, sounds are rich in quality and stereoscopic sensation, a real sound field relationship can be restored, an in-head effect is avoided, and a requirement for real synchronization between a sound and an image in a VR panoramic video technology is met.

DESCRIPTION OF EMBODIMENTS

To make the objectives, technical solutions, and advantages of the present invention clearer and more comprehensible, the following further describes the present invention in detail with reference to the accompanying drawings and embodiments. It should be understood that the specific embodiments described herein are merely used to explain the present invention but are not intended to limit the present invention.

The present invention provides a recording device. Multiple fixed apparatuses are stacked and have ear structures and face contours, and audio collectors are disposed at ear canal openings of the ear structures to collect audio information. During audio collection, faces of the fixed apparatuses have different horizontal orientations, so that the audio collectors obtain the audio information at the ear canal openings of the ear structures towards horizontal directions. Therefore, rich sound sources and sound authenticity are ensured, sounds are rich in quality, a stereo field perception effect is achieved, a real sound field relationship can be restored, an in-head effect is avoided, and a requirement for real synchronization between a sound and an image in a VR panoramic video technology is met.

Figure 1:
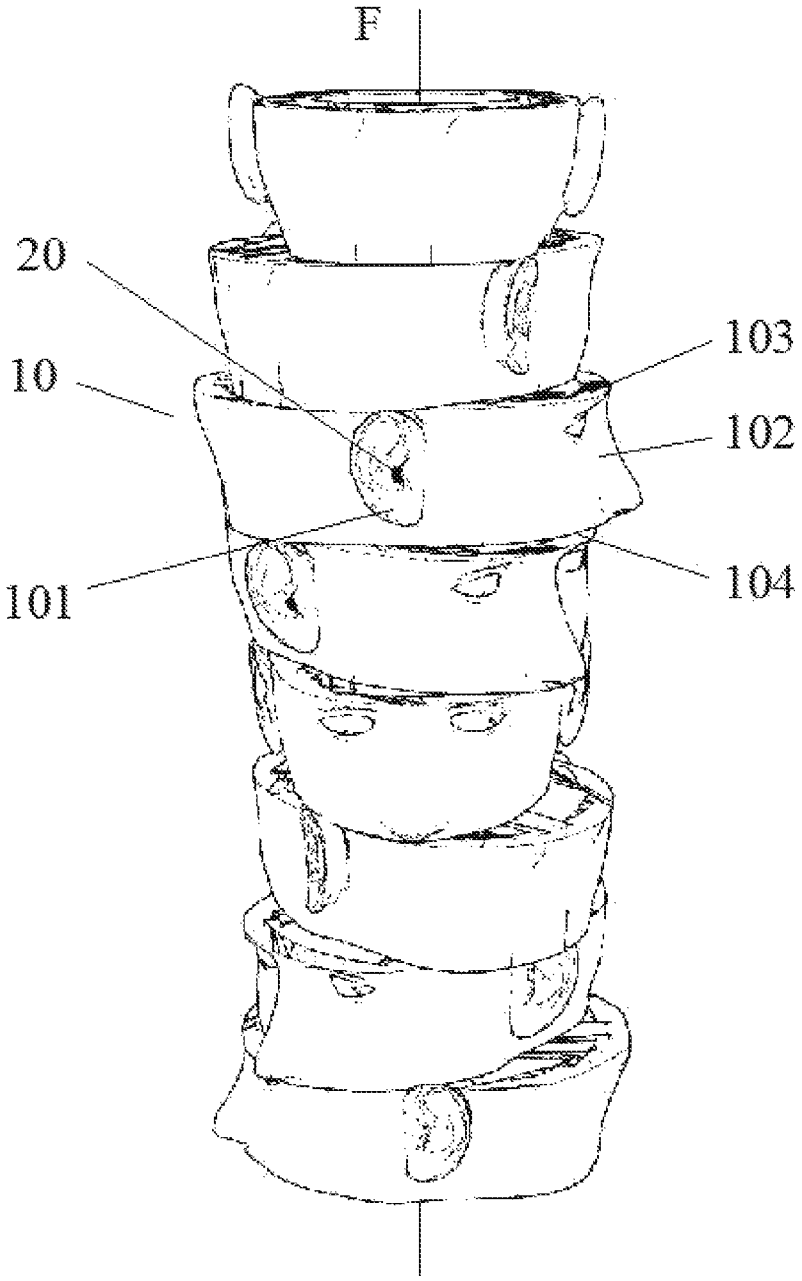
FIG. 1 is an integral structure diagram of an audio collection apparatus according to an embodiment of the present invention.

As shown in FIG. 1, in an embodiment of the present invention, an audio collection apparatus includes multiple stacked fixed apparatuses 10 and multiple audio collectors 20. The fixed apparatuses 10 have ear structures 101 and face contours 102, and the audio collectors 20 are separately disposed at ear canal openings of the ear structures 101 of the fixed apparatuses 10. During audio collection, faces of the fixed apparatuses 10 are towards different horizontal directions, so that the ear structures 101 of the fixed apparatuses 10 are also towards different horizontal directions, and the audio collectors 20 disposed at the ear canal openings of the ear structures 101 can collect audio signals at the ear canal openings of these ear structures 101 towards these different horizontal orientations. A process of conducting a sound to an ear drum through an auricle, an external ear, and an ear canal in the ear structure 101 of the fixed apparatus 10 is similar to a process of transmitting a sound to a human ear, so that the audio collector 20 disposed at the ear canal opening of the ear structure 101 can collect audio information that is the same as a natural sound heard by the human ear, the sound is rich in quality, and stereoscopic sensation and authenticity of the sound are ensured.

In this embodiment of the present invention, the fixed apparatuses 10 are stacked, so that blockage and impact exerted by another fixed apparatus 10 on a sound transmitted to each ear structure 101 can be minimized.

In an embodiment of the present invention, a human head model is used as an external structure of the fixed apparatus 10, and an effect of reflecting and diffracting sound waves by human auricles, ear canals, the human skull, and the like can be simulated. Therefore, the audio collectors 20 disposed in the ear structures 101 can collect verisimilar audio signals. The human head model may be a simulated human head model, such as a bionic model, or a human head model that has been dimmed and simplified. The simulated human head model can make a collected audio signal more precise and more targeted, and the human head model that has been dimmed and simplified makes the head contour close to an average level by reducing personal features, so as to improve integral applicability. In the foregoing manner, a real sound field is restored for users, verisimilar stereoscopic sensation is achieved, and discomfort and a strong in-head effect caused when flat sounds are directly transmitted between the left ear and the right ear in conventional recording are avoided.

In an embodiment of the present invention, the fixed apparatus 10 may be an integrated human head model or a part of a human head model, that is, the fixed apparatus 10 is obtained by cutting along a cross section. The cross section includes a top cross section 103 and a bottom cross section 104. When the human head model is obtained in a cutting manner, a longitudinal height of the human head model is reduced while keeping an ear structure and a face contour, so that it is ensured that verisimilar audio signals that are rich in quality and stereoscopic sensation can be collected, and a vertical distance between the audio collectors 20 disposed on the fixed apparatuses 10 is as small as possible. Therefore, collected audio signals are as close as possible to an effect of recording on a same horizontal plane.

In an embodiment of the present invention, the top cross section 103 is a cross section on which eyebrows of the human head model are located, and the bottom cross section 104 is a cross section on which the mouth of the human head model is located. A human head model obtained by cutting along the foregoing two cross sections reserves a complete ear structure 101 and a relatively large face contour 102. In this cutting manner, not only the human head model has a relatively small longitudinal height, but also most of a contour that has main impact on sounds transmitted to the human ears is retained. Therefore, integral quality, stereoscopic sensation, and real restoration of collected audio signals are ensured.

In an embodiment of the present invention, a line that connects a central point of the top cross section 103 and a central point of the bottom cross section 104 of the fixed apparatus 10 is used as a central axis F of the fixed apparatus 10, and the fixed apparatuses 10 are vertically arranged by mutually overlapping central axes F, so that projections of the fixed apparatuses 10 on a horizontal plane can be overlapped with each other to the largest extent, so as to simulate a status in which a human head is in a same position but faces different horizontal directions in reality. Further, the audio collectors 20 disposed at the ear canal openings of the ear structures 101 can collect audio signals at the ear canal openings of the ear structures 101 when the human head is in the same position but faces different horizontal directions, so as to avoid problems that because there is an extremely large interval between the fixed apparatuses 10 in a horizontal direction, recorded audio signals present sounds that are not in the same position, so that when a user experiences a VR panoramic video, an image presents one place but sounds sound like to be from another place, and the obtained sounds cannot completely coincide with an image of the VR panoramic video.

In an embodiment of the present invention, the number of the fixed apparatuses 10 is expressed by N, where N≥4. That is, there are at least 4 fixed apparatuses 10, so that sources of collected audio signals are richer.

During audio collection, facial orientations of the fixed apparatuses 10 are staggered around the central axis F at an interval of an angle obtained by equally dividing a 360-degree horizontal angle into N parts. Accordingly, the ear structures 101 of the fixed apparatuses 10 are also evenly towards corresponding horizontal directions around the central axis F, so that corresponding audio collectors 20 are evenly arranged within a range of 360 degrees in the horizontal direction. In such an arrangement manner, the range of 360 degrees in the horizontal direction can be well and evenly covered. With an increase in the number of fixed apparatuses 10 and the number of audio collectors 20, the device can evenly capture corresponding audio signals in all directions, so as to avoid a problem that 360-degree complete synchronization with an image of a VR panoramic video cannot be achieved because corresponding audio signals in some directions are not collected due to uneven arrangement.

Figure 2:
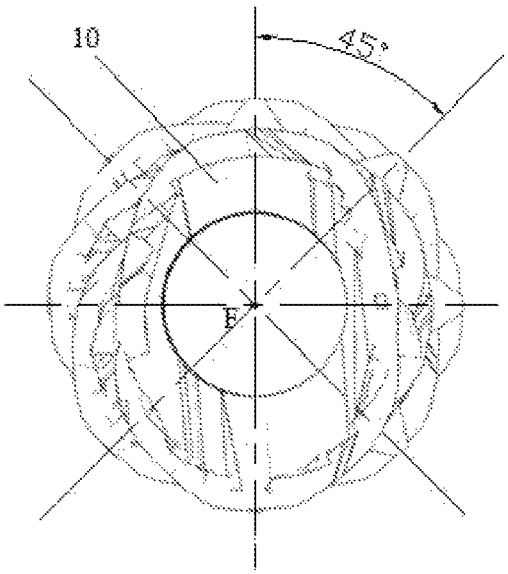
FIG. 2 is a top view of an audio collection apparatus according to an embodiment of the present invention.

Referring to FIG. 1 and FIG. 2, in an embodiment of the present invention, there are 8 fixed apparatuses, faces of the fixed apparatuses 10 are staggered around a central axis F at a 45-degree horizontal angle, so that the 8 fixed apparatuses 10 are distributed within a range of 360 degrees in a horizontal plane at even horizontal angles. Two audio collectors 20 corresponding to two ear structures 101 of each fixed apparatus 10 form a collection group, and the interval of a 45-degree horizontal angle can completely meet resolution of the human ear. There is one collection group every other 45 degrees, and audio signals obtained by each collection group can present a stereo sound field at a corresponding angle, so that an image of a VR panoramic video can perfectly accord with a sound.

Figure 3:
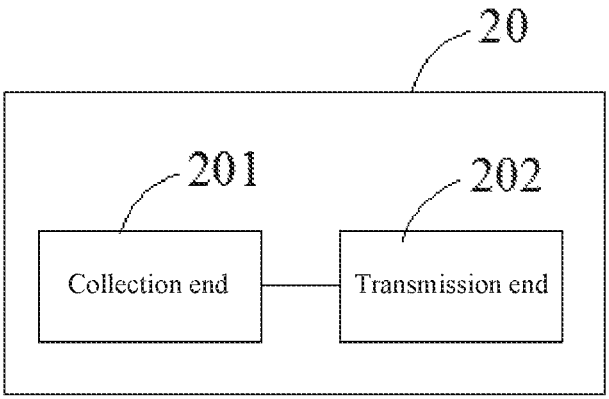
FIG. 3 is an audio collector module diagram of an audio collection apparatus according to an embodiment of the present invention.

Referring to FIG. 1 and FIG. 3, in an embodiment of the present invention, the audio collector 20 includes a collection end 201 configured to collect audio signals and a transmission end 202 that is connected to the collection end 201 and configured to transmit the collected audio signals to a storage device. The audio collector 20 may be a microphone, an audio monitoring unit, or another apparatus with an audio collection function. The collection end 201 is of an omni-directional structure, so as to capture audio signals transmitted by an external sound source through a medium such as air. The transmission end 202 may be a transmission line or a wireless module, and transmit an audio signal to a corresponding storage device in a wired or wireless manner.

In an embodiment of the present invention, two audio collectors 20 on each fixed apparatus 10 share one transmission end 202, that is, a collection end 201 is placed in each of the two ear structures 101 of each fixed apparatus 10, and the two collection ends 201 are connected to a common transmission end 202, so as to transmit double-channel audio signals collected by the fixed apparatus 10 to the storage device. When the audio collection apparatus includes 8 fixed apparatuses 10, there are correspondingly 16 collection ends, and the 16 collection ends correspond to 8 transmission ends. The 8 transmission ends transmit audio signals in a wired manner to a storage device that has at least 8 corresponding interfaces, or transmit audio signals to a storage device in a wireless manner.

The audio collection apparatus provided in the embodiment of the present invention includes fixed apparatuses that have ear structures and face contours. Audio collectors are disposed at ear canal openings of the ear structures to collect audio information, and the multiple fixed apparatuses are stacked. During audio collection, faces of human head models are towards different horizontal orientations, so that the audio collectors obtain the audio information at the ear canal openings of the ear structures towards horizontal directions. Therefore, rich sound sources and sound authenticity are ensured, sounds are rich in quality and stereoscopic sensation, a real sound field relationship can be restored, an in-head effect is avoided, and a requirement for real synchronization between a sound and an image in a VR panoramic video technology is met.

The foregoing descriptions are merely preferred embodiments of the present invention, but are not intended to limit the present invention. Any modification, equivalent replacement, improvement, or the like made within the spirit and principle of the present invention shall fall within the protection scope of the present invention.

The invention claimed is:

1. An audio collection apparatus, comprising:

multiple stacked human head models that are complete in shape or is obtained by cutting along a cross section, wherein the cross section comprises a top cross section and a bottom cross section such human head models having ear structures and face contours;

wherein a straight line on which a central point of the top cross section and a central point of the bottom cross section of the human head model are located is used as a central axis of the human head model, and the human head models are vertically stacked by mutually overlapping central axes wherein the number of the human head models is eight, and during audio collection, the faces of the human head models are mutually staggered around the central axis at an interval of an angle obtained by equally dividing a 360-degree horizontal angle into eight parts and audio collectors that are disposed at ear canal openings of the ear structures and configured to collect audio signals at the ear canal openings.

2. The audio collection apparatus according to claim 1, wherein the human head model is a bionic human head model or a human head model that has been simplified.

3. The audio collection apparatus according to claim 1, wherein the top cross section passes through eyebrows of the human head model, and the bottom cross section passes through the mouth of the human head model.

* * * * *